United States Patent [19]

Forslund et al.

[11] Patent Number: 4,695,414

[45] Date of Patent: Sep. 22, 1987

[54] METHOD AND APPARATUS FOR PRESSING POWDER MATERIAL

[75] Inventors: Alf Forslund; Goran Andersson, both of Harnosand, Sweden

[73] Assignee: Convey Teknik AB, Harnosand, Sweden

[21] Appl. No.: 625,953

[22] Filed: Jun. 29, 1984

[30] Foreign Application Priority Data

Jul. 1, 1983 [SE] Sweden ..... 8303796

[51] Int. Cl.[4] ..... C06B 21/00

[52] U.S. Cl. ..... 264/3.1; 264/3.3; 264/3.4

[58] Field of Search ..... 264/3 R, 3 B, 3 C; 419/68; 100/35, 50, 99

[56] References Cited

U.S. PATENT DOCUMENTS

| | | | |
|---|---|---|---|
| 4,195,563 | 4/1980 | Budraitis et al. | 100/50 X |
| 4,250,792 | 2/1981 | Deigmuller et al. | 264/3 R X |
| 4,335,063 | 6/1982 | Kolb et al. | 264/3 B |
| 4,453,421 | 6/1984 | Umano | 100/99 X |
| 4,455,914 | 6/1984 | Christmann et al. | 264/3 R X |
| 4,461,182 | 7/1984 | Jones, Jr. et al. | 100/99 X |
| 4,545,755 | 10/1985 | Furch et al. | 264/3 C X |

FOREIGN PATENT DOCUMENTS

| | | | |
|---|---|---|---|
| 2838133 | 9/1978 | Fed. Rep. of Germany | 264/3 B |

*Primary Examiner*—Peter A. Nelson

*Attorney, Agent, or Firm*—John A. Mitchell

[57] ABSTRACT

A method and apparatus for pressing powder material in which powder is dosed into a die (48) and with the aid of at least one press means (14) is compressed to a ready detail, pressing continuing until a desired final position of the press means or a desired press force has been achieved.

The actual value for the position of the press means (14) is sensed when desired press force has been achieved, or the actual value for the press force is registered when the final position has been achieved. The registered actual value is compared with a predetermined criterion value and the pressed detail is accepted or rejected depending on the size of the deviation between actual and criterion values.

4 Claims, 3 Drawing Figures

METHOD AND APPARATUS FOR PRESSING POWDER MATERIAL

The present invention relates to an apparatus for pressing powder material, in which powder is dosed into a die and is compressed to a ready detail with the aid of at least one press means, compression continuing until a desired final position of the press means or a desired compressive force has been achieved. The invention also relates to apparatus for carrying out the method.

In pressing details from powder material, the quantity of powder calculated for forming the detail is dosed into the die as accurately as possible with the aid of a dosing device. In the cases where the dimensions of the detail are decisive for the continued use of the detail, pressing is usually carried out until a desired final position of the press means or punch has been arrived at, the dimension in the compression direction thus being obtained with relatively high accuracy. If density is decisive for the use of the pressed detail, compression then takes place until a desired or predetermined compressive force has been arrived at, which by experience corresponds to the desired density.

Since the same amount of powder is always dosed into the press die, all details should be the same with respect to the desired properties, i.e. dimensions and/or density. This is not the case however, since faults can occur both in the dosing procedure and in the dosing device. Deficiencies can also occur in the composition, quality and physical properties of the powder material. Up to now it has therefore been necessary to check the ready details after pressing in respect of desired properties and this has usually been done with the aid of spot checks. A check of this kind does indeed ensure that an entire series of incorrect details will not be produced but the check will not be a hundred percent sure since occasional incorrect details can pass without being checked.

Against the background of the above, the main object of the invention is to provide a method and apparatus for pressing powder material, in which each ready-pressed detail is checked simply and cheaply in conjunction with pressing so that details deviating from given limits can be rejected directly at or after production.

These and other objects of the invention are achieved by the method and apparatus being given the characterizing features disclosed in the following claims.

Other objects and advantages of the invention will be apparent from the following description in detail of one embodiment of a press for carrying out the method.

Figure 1:
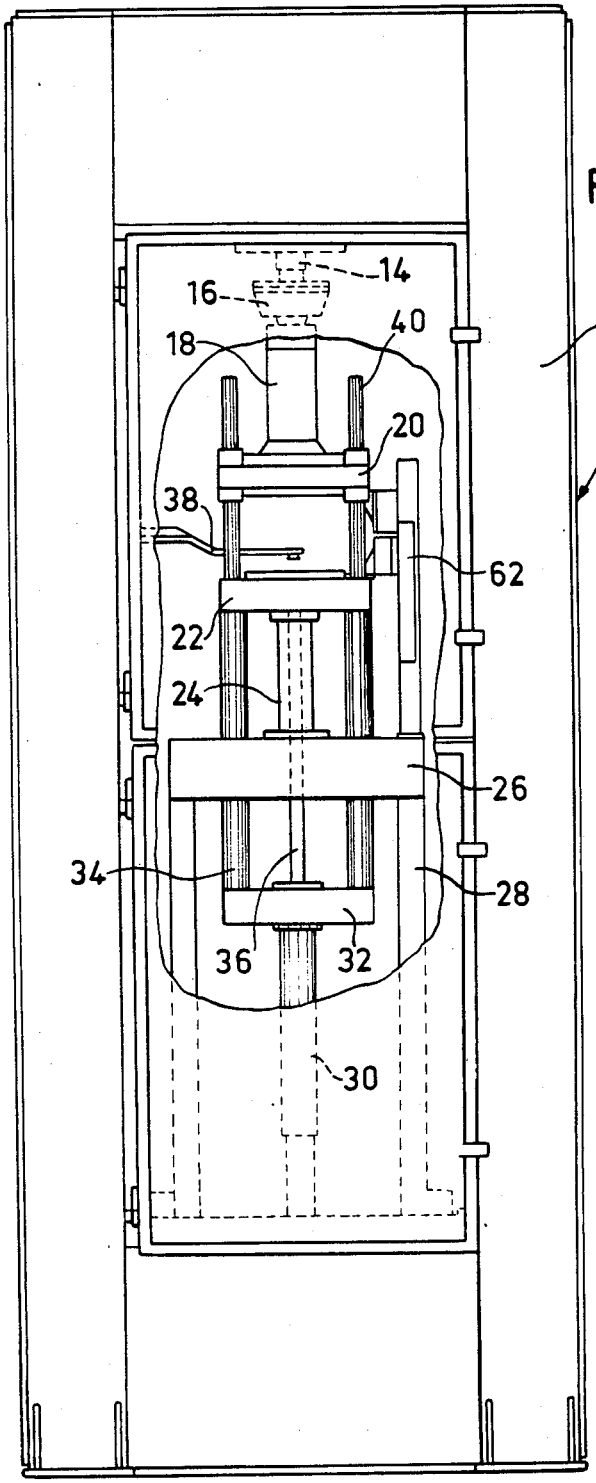
FIG. 1 is a side view of a powder press with the front end wall partially cut away to show the interior of the press.

The press illustrated in FIG. 1, generally denoted by the numeral 10, is intended for pressing different kinds of powder materials such as metals, ceramic material, explosives etc. and is designed according to the withdrawal principle, which is described more clearly below. The press 10 includes a frame 12 comprising side members and upper and lower cross members. An upper hydraulic cylinder 14 is attached to the upper cross member of the frame 12, and via a spherical bearing 16 and extension sleeve 18 is connected to the upper press table 20 carrying the upper ram, which is described in detail below. The press die is arranged on a die table 22, while the lower punch is carried by a lower ram support sleeve 24 attached to a base plate 26 having legs 28 connected to the lower cross member of the press frame 12. Movement of the die is provided with the aid of a lower hydraulic cylinder 30 the piston rod of which is attached to a lower cylinder carrier plate 32 carrying a pair of lower guide columns 34 and a core rod 36 for the die, the rod passing inside the lower ram support sleeve 24. The lower guide columns 34 are mounted for sliding in the base plate 26. Above the die table 22 there is arranged a picking arm 38 for taking away the ready details, this arm 38 being movable from the illustrated picking position to a rejection position and also to a position for further conveyance of the ready details. The press is otherwise equipped with an unillustrated powder dosing device for dosing powder into the die.

Figure 2:
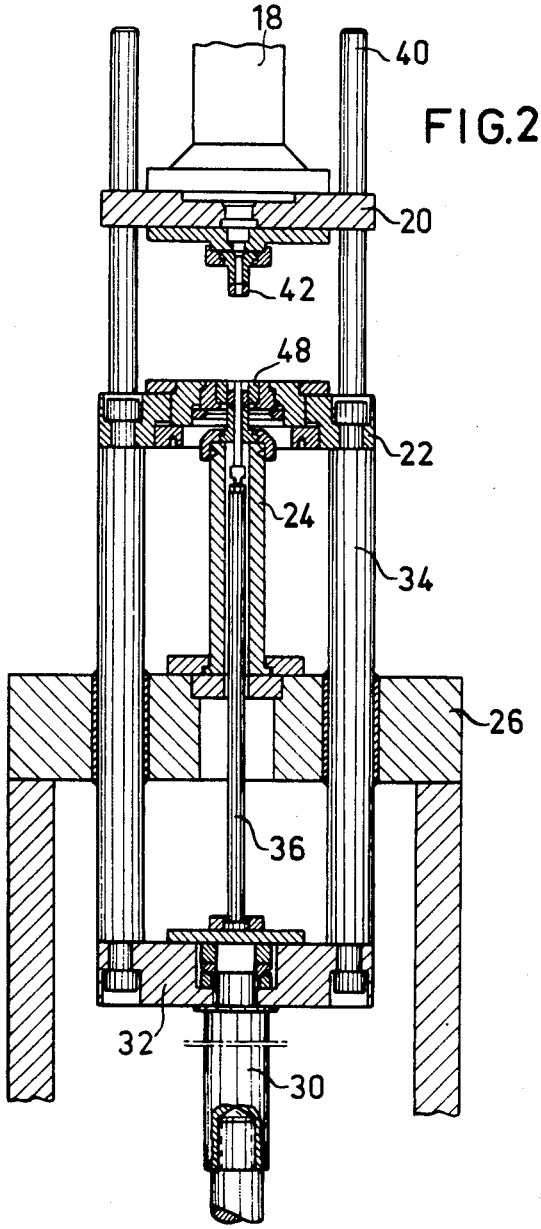
FIG. 2 is a longitudinal section through the pressing means or punches of the powder press and associated operating means.
Figure 3:
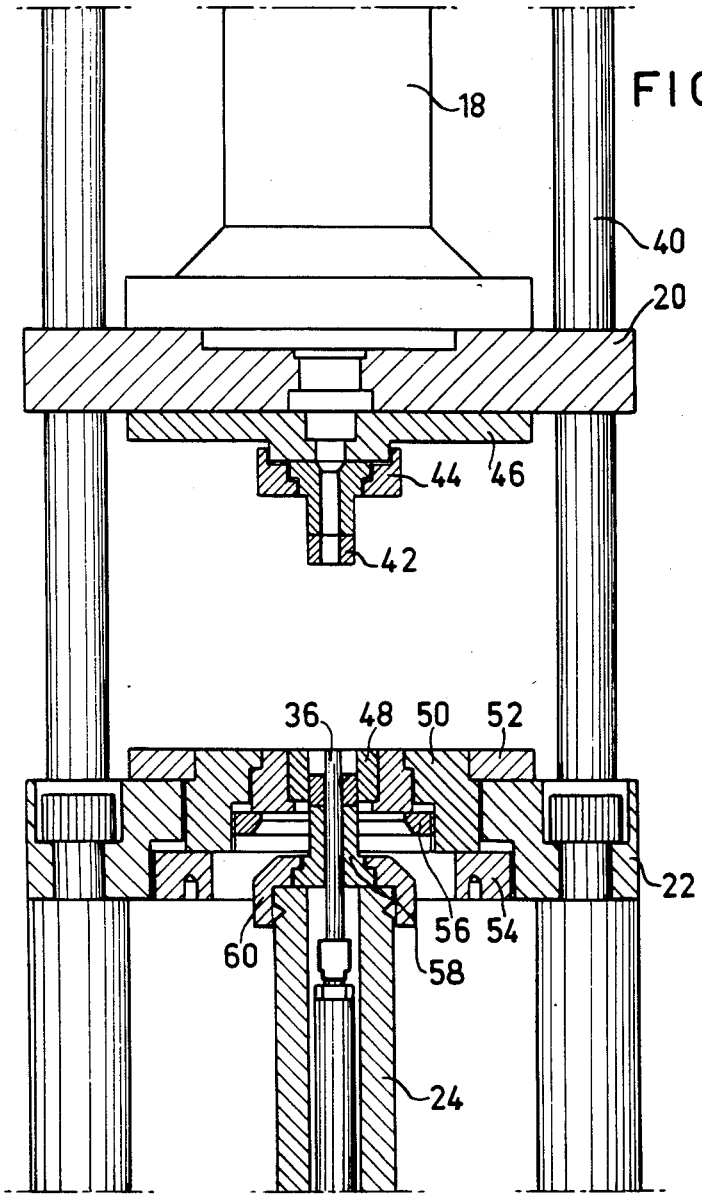
FIG. 3 illustrates to a larger scale the upper portion of FIG. 2.

As will be seen from FIGS. 2 and 3, the upper press table 20 is guided by upper guide columns 40 and carries in the punching device an upper punch 42 which is attached to the upper press table 20 with the aid of a locking ring 44 and an upper punch plate 46. The die table 22 carries the die 48, die collar 50, a slip plate 52 and locking rings 54 and 56. The lower punch is denoted by the numeral 58, and is provided with a locking ring 60.

As mentioned above, the press is designed according to the withdrawal principle, i.e. the lower punch 58 is stationary while the die 48 is movable. Press movement is carried out by the press cylinder 14 for the upper punch 42 and the withdrawal cylinder 30 for the die 48. In accordance with the invention, the press is provided with a positional indicator for the press cylinder 14 and a positional indicator for the withdrawal cylinder 30, as illustrated schematically at 62 in FIG. 1, these indicators constantly registering the positions of the upper punch 42 and die 48 in space, and thereby in relation to each other. The press cylinder 14 is furthermore controlled by a force transducer (unillustrated), there also being a force transducer (unillustrated) for registering the force on the withdrawal cylinder 30. The cylinders 14, 30 are coupled in so that they mutually independently can be driven with different sequences, speed and to different final positions. The press cylinder 14 can be operated until the correct press force has been arrived at instead of a given position.

After a predetermined volume of powder has been dosed into the die 48, and with the picking device 38 swung away to a rest position, the press can be operated either with positional or force control of the press cylinder 14.

For positional control the cylinder 14 moves with optional speed to the set press position of the upper punch 42, this position being determined by the positional indicator 62 with great accuracy. At the end of the press time, the press force is reduced to a set counter force with the aid of the force transducer controlling the cylinder 14, and the counter force is then kept with the desired accuracy during the withdrawing movement of the withdrawing cylinder 30. This withdrawing movement takes place by the die being lowered with the aid of the guide pillars 34 slidably mounted in the base plate 26, which lowers the die table 22 over the fixed core rod 36. With the aid of the force transducers of the press cylinder 14 and withdrawal cylinder 30, the press forces in the different operational positions of the upper punch and die can be sensed with great accuracy. With the described positional control, limiting values may be selected for the maximum and minimum press force for the pressed detail to have the density required by experience. Should the press force exerted not lie within the set limiting values when the press position has been achieved, this indicates that the detail is incorrect primarily with respect to the density achieved. In such a case the operational cycle is interrupted, the picking arm 38 goes in and collects the incorrectly pressed detail and discharges it and the arm returns to a rejection position. On the other hand, if the press force is within the set limiting values, the detail is acceptable, and the picking arm 38 deposits it in a position for further transport.

If it is desired instead to keep control of the pressed details by checking the dimensions, the press can be operated with force control, which means that the press cylinder 14 moves at a selectable speed until set press force is arrived at according to the force transducer of the press cylinder 14. The work cycle is then the same as described for positional control above. For force control it is thus possible to select the limiting values for the maximum or minimum press position, which is indicated by the transducers 62. If the press position reached by the upper punch 42 is not within the set limits at the achieved, predetermined press force, this indicates that the dimensions of the detail will be incorrect and the detail is rejected with the aid of the picking arm 38 in the same way as described above. On the other hand, if the press position is within the set limiting values of the upper punch 42 and the die 48 for the press force arrived at, the detail is acceptable and can be taken away for further use.

As will be seen from the above, there is achieved in accordance with the invention a pressing method where the pressed detail is already checked with respect to desired properties in conjunction with pressing, so that it can safely be determined that each pressed detail meets the demands put on it. The illustrated embodiment is of course only one example of how the invention may be realized, and the invention may be modified and varied within the scope of the following claims.

We claim:

1. A method for pressing powder material with a press, the press including a stationary punch, a movable punch, and a movable die, the method comprising the steps of:

dosing the powder material into the die;

pressing the powder material between the stationary punch and the movable punch until a predetermined position of the movable punch is reached;

stopping the movable punch when the predetermined punch position is reached;

sensing an actual value of force on the movable punch when the predetermined punch position is reached;

after the stopping and sensing steps, comparing the actual value of punch force with a preselected criterion;

rejecting the pressed powder material if the actual value of punch force deviates from the preselected criterion by more than a predetermined amount; and moving the die relative to the stationary punch to withdraw the pressed powder material.

2. A method as recited in claim 1, further comprising the step of halting the movable punch at a predefined distance from the predetermined punch position if the actual value of punch force at said predefined distance is less than a preselected percentage of the preselected criterion.

3. A method as recited in claim 1, wherein the pressing step includes controlling the movable punch according to punch force after a predefined pressing time.

4. A method of pressing powder material with a press, the press including a stationary punch, a movable punch, and a movable die, the method comprising the steps of:

dosing the powder material into the die;

pressing the powder material between the stationary punch and the movable punch until a predetermined force on the movable punch is obtained;

stopping the movable punch when the predetermined punch force is obtained;

sensing an actual value of position of the movable punch after the predetermined punch force is obtained;

after the stopping and sensing steps, comparing the actual value of punch position with a preselected criterion; and rejecting the pressed powder material if the actual value of punch position deviates from the preselected criterion by more than a predetermined amount; and moving the die relative to the stationary punch to withdraw the pressed powder material.

* * * * *